US009248418B1

(12) United States Patent
Smith et al.

(10) Patent No.: US 9,248,418 B1
(45) Date of Patent: Feb. 2, 2016

(54) WAFER MIXING DEVICE

(71) Applicant: Komax Systems, Inc., Huntington Beach, CA (US)

(72) Inventors: Robert Smith, Seal Beach, CA (US); Nolan Smith, Hermosa Beach, CA (US); Seungsuk Lee, Anaheim, CA (US)

( * ) Notice: Subject to any disclaimer, the term of this patent is extended or adjusted under 35 U.S.C. 154(b) by 67 days.

(21) Appl. No.: 14/230,468

(22) Filed: Mar. 31, 2014

(51) Int. Cl.
*B01F 5/06* (2006.01)

(52) U.S. Cl.
CPC ..... *B01F 5/061* (2013.01)

(58) Field of Classification Search
CPC .. B01F 5/061; B01F 5/064; B01F 2005/0625; B01F 2005/0627; B01F 2005/0631; B01F 2005/0639
USPC ..... 366/340
See application file for complete search history.

(56) References Cited

U.S. PATENT DOCUMENTS

| | | | | |
|---|---|---|---|---|
| 1,496,345 | A | | 6/1924 | Lichtenthaeler |
| 1,626,487 | A | | 4/1927 | Warren |
| 1,776,135 | A | | 9/1930 | Smith |
| 1,893,484 | A | | 1/1933 | Belt |
| 2,000,953 | A | | 5/1935 | Hokker et al. |
| 2,081,043 | A | | 5/1937 | Kuhni |
| 2,508,247 | A | | 5/1950 | Giauque |
| 2,784,948 | A | | 3/1957 | Pahl et al. |
| 2,816,518 | A | | 12/1957 | Daggett |
| 2,831,754 | A | | 4/1958 | Manka |
| 3,643,735 | A | | 2/1972 | Huggins |
| 3,923,288 | A | | 12/1975 | King |
| 4,053,141 | A | | 10/1977 | Gussefeld |
| 4,068,830 | A | * | 1/1978 | Gray ..... 366/175.2 |
| 4,371,036 | A | | 2/1983 | Fordsmand |
| 4,408,890 | A | | 10/1983 | Beckmann |
| 4,441,823 | A | | 4/1984 | Power |
| 4,552,211 | A | | 11/1985 | Weber |
| 4,614,440 | A | | 9/1986 | King |
| 4,616,937 | A | | 10/1986 | King |
| 4,674,888 | A | | 6/1987 | Carlson |
| 4,753,535 | A | | 6/1988 | King |
| 4,808,007 | A | | 2/1989 | King |
| 4,812,049 | A | | 3/1989 | McCall |
| 4,893,672 | A | | 1/1990 | Bader |
| 4,998,583 | A | | 3/1991 | Lahne et al. |
| 5,046,548 | A | | 9/1991 | Tilly |
| 5,176,448 | A | | 1/1993 | King et al. |
| 5,388,906 | A | * | 2/1995 | Rao ..... 366/173.2 |
| 5,597,236 | A | | 1/1997 | Fasano |
| 5,765,946 | A | | 6/1998 | Lott |
| 5,839,828 | A | * | 11/1998 | Glanville ..... 366/340 |
| 5,865,537 | A | | 2/1999 | Streiff et al. |
| 5,947,597 | A | | 9/1999 | King |
| 6,027,241 | A | * | 2/2000 | King ..... 366/181.5 |

* cited by examiner

*Primary Examiner* — Tony G Soohoo
*Assistant Examiner* — Elizabeth Insler
(74) *Attorney, Agent, or Firm* — Bay Area Technology Law Group PC

(57) ABSTRACT

A stationary material mixing apparatus located within a cylindrically-shaped conduit. The material mixing apparatus includes a front face, rear face, cone-shaped module having a base and apex supported on said front face and extending toward an upstream end of the conduit. A channel for introducing an additive to the fluid stream is provided, the additive being introduced at the apex of the cone-shaped module, the material mixing apparatus further being provided with three circular openings positioned 120 degrees from each other and each having a baffle configured therein.

6 Claims, 1 Drawing Sheet

WAFER MIXING DEVICE

TECHNICAL FIELD

The present invention deals with a static mixing apparatus capable of enhancing the speed and efficiency of mixing two fluids. The material mixing apparatus is of a wafer configuration ideally suited for positioning between connecting flanges of a conduit used for the passage of fluid therein.

BACKGROUND OF THE INVENTION

It is common practice to mix particulate solids, liquids and gases with motionless mixers having, as the name implies, no moving parts. Mixers of this category consist of baffles of various types arranged sequentially in a tube or pipe. By a process of division and recombination, separate input components can be mixed or dispersed within one another in travelling through the pipe tube or at its output. Static or motionless mixers are composed of a series of geometrically arranged mixing elements fitted within a pipe or tube, the energy of the flow stream being employed to create mixing between two or more fluids. The goal is to maximize fluid mixing while experiencing the lowest pressure loss possible.

Within the general category of static or motionless mixers, there are those referred to as wafer mixers. They are called wafer mixers because they are generally thin and are designed for applications where length is critical or for mixing low viscosity chemicals into a low viscosity stream at very high velocities. Oftentimes, wafer mixers are used with other static mixing devices as an overall solution to fluid mixing. A wafer mixer can be used at the joinder of two or more pipe lengths by fitting it between connecting flanges as noted in reference to FIG. 2. Oftentimes, wafer mixers are employed to provide mixing when the alternative is to not mix at all. Wafer mixers afford an inexpensive static mixing solution for many applications where some level of mixing is needed. Also, wafer static mixers work best when they are used for constant flow conditions. They are not well suited for applications having large differences between maximum and minimum flow rates.

Although wafer mixers should oftentimes be used with other static mixing devices, one should always strive to provide the maximum mixing efficiency whenever a mixer is employed. Most wafer mixing designs, fail to provide a high degree of turbulence or mixing in the downstream pipe length. Further, many do not provide for the injection and mixing of additives, such as those employed in water treatment. Thus, the present invention is intended to address these issues by providing a wafer mixer of far superior design and efficiency.

These and further objects will be readily apparent when considering the following disclosure and appended claims.

SUMMARY OF THE INVENTION

A stationary material mixing apparatus located within a cylindrically-shaped conduit, said conduit having upstream and downstream ends, a circular cross-section and longitudinal axis located along its geometric center, said material mixing apparatus providing for mixing an additive into a fluid stream moving from said upstream end to said downstream end within said conduit, said material mixing apparatus comprising a front face facing said upstream end and a rear face facing said downstream end and a circular periphery sized to occupy substantially the entire cross-section of said conduit, said front and rear faces of said material mixing apparatus having a geometric center, a cone-shaped module having a base and apex, said base being supported by said front face at said geometric center, said apex extending toward the upstream end of said conduit, a channel for introducing an additive to said fluid stream, said cone-shaped module being in fluid communication with said channel for receipt and passage of said additive from the apex of said cone-shaped module into said fluid stream, said stationary material mixing apparatus further comprising three circular openings configured therein for passage of said fluid stream within said conduit, said circular openings being equidistant from said geometric center spaced approximately 120 degrees from each other and each opening being fitted with a baffle, a first edge thereof being curved to mate with a circular opening to which it is fitted and a second edge, said second edge defining the extent to which each baffle extends away from said longitudinal axis, said baffle being angled away from said front face of said mixing apparatus.

DETAILED DESCRIPTION OF THE INVENTION

Figure 1:
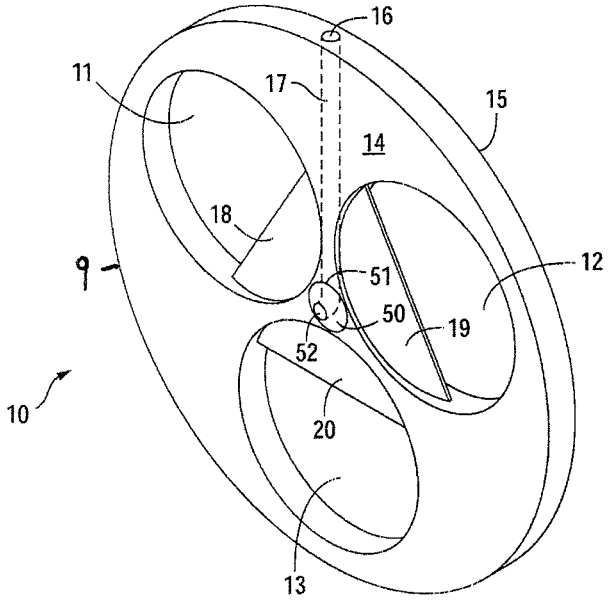
FIG. 1 is a perspective view of the wafer mixing device of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Figure 2:
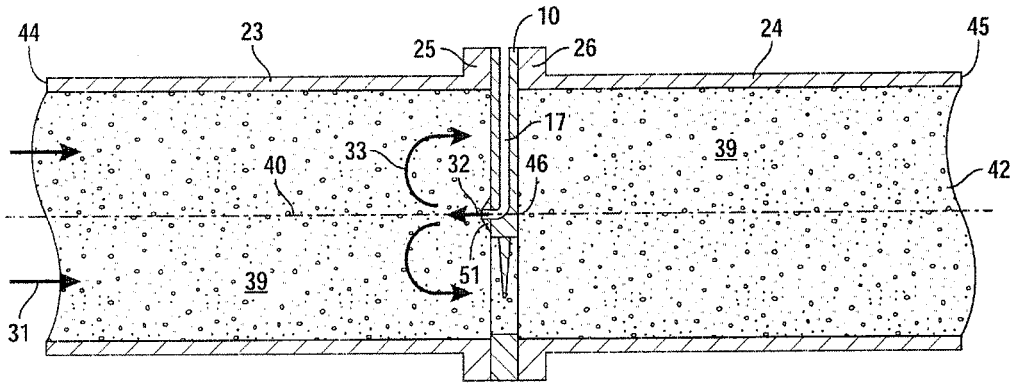
FIG. 2 is a cross-sectional view of the wafer mixing device of FIG. 1 installed as it typically would in joined conduits where fluids to be mixed are caused to travel.

The present invention involves a stationary material mixing apparatus 10 configured to be located within a cylindrically-shaped conduit such as that shown in FIG. 2 in the joinder of upstream conduit 23 and downstream conduit 24 joined by flanges 25 and 26. The conduit is provided with longitudinal axis 40 coinciding with the geometric center 46 of stationary material mixing apparatus 10. The conduit is characterized as typically having circular cross-section 42, uniform across its entire length.

The purpose for material mixing apparatus 10 is for providing the mixing of an additive into fluid stream 39 moving from upstream end 44 to downstream end 45 in the direction of arrows 31.

In turning to FIG. 1, stationary material mixing apparatus 10 is characterized as having front face 14 which, when installed within an appropriate conduit, faces its upstream end 44 and rear face 15 faces its downstream end 45. Stationary material mixing apparatus 10 also has a circular periphery 9 sized to occupy the entire cross-section of the conduit.

Front and rear faces 14 and 15, respectively, of material mixing apparatus 10, are provided with geometric center 46 at which is located cone-shaped module 50 having base 51 and apex 52, base 51 being supported by front face 14, again, at its geometric center 46 as shown. When installed within a suitable conduit, apex 52 extends towards upstream end 44 such that fluid exiting from geometric center 52 in the direction of arrow 32 is countercurrent to fluid flow 39 travelling within upstream conduit 23 in the direction of arrows 31.

As is quite apparent from the above discussion, the goal of the present invention is to provide idealized mixing of an additive into a travelling fluid stream. This is most ideally accomplished by providing channel 17 between front and rear faces 14 and 15 of wafer mixing device 10. Additive would enter channel 17 at opening 16 and under suitable pressure, proceed to geometric center 46 entering upstream conduit 23 through an opening in apex 52 of cone-shaped module 50 in the direction of arrow 32.

As is noted in reference to FIG. 1, stationary material mixing apparatus 10 is configured with three openings, 11, 12 and 13, each having a geometric center spaced approximately 120 degrees from adjacent openings. Thus, openings 11, 12 and 13 are equally spaced, providing for the passage of additive and main fluid from upstream conduit 23 to downstream conduit 24. Preferably, the openings should be sized to maximize their areas while maintaining portions of front and rear faces 14 and 15 such that the openings do not actually touch one another. Obviously, the larger are openings 11, 12 and 13, the greater the area will be for the passage of the fluid there through.

As further noted in reference to FIG. 1, openings 11, 12 and 13 are each provided with a baffle, baffles 18, 19 and 20 being fitted into each opening as shown. The baffles are configured with a first rounded edge conforming to the circumference of the opening to which it is fitted as well as a second edge extending to partially occupy the opening to which it is situated. Baffles 18, 19 and 20 cause fluid traveling through openings 11, 12 and 13 to be deflected towards the walls of the conduit thus increasing shear and enhancing the quality of mixing. Further as shown, baffles 18, 19 and 20 are angled away from front face 14, the ideal angle being approximately 20 degrees thereto. As noted in reference to FIG. 2, ideally, stationary material mixing apparatus 10 can be affixed between flanges 25 and 26 of upstream conduit 23 and downstream conduit 24, respectively. Suitable bolts and through holes (not shown) are configured within these flanges and through stationary mixing apparatus 10 in a conventional fashion.

Figure 3:
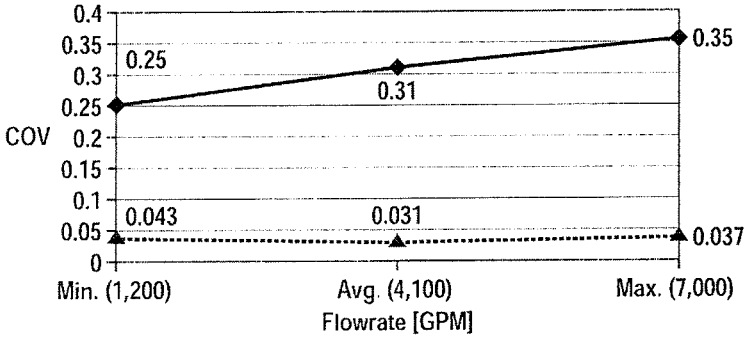
FIG. 3 is a graphical illustration of improvements derived from practicing the present invention.

Typically, conventional wafer material mixing devices have two rather than three circular openings and can be provided with deflectors. The efficiency of any material mixing device of the type described herein can be measured by the coefficient of variance as measured downstream from the mixer. The lower the coefficient of variance, the more effectively the additive fluid introduced in the direction of arrow 32 mixes with fluid 39. In reference to FIG. 3, it is noted that over a typical flow rate of 1200 to 7000 gpm, the present invention (broken line) displays a significantly better COV than that of the prior art (solid line). This is attributable to the three openings which are maximized in area through wafer faces 14 and 15 and the placement of baffles 18, 19 and 20 positioned within the openings as proximate as possible to center 46 occupying between approximately 30 to 70% of the area of each of the openings and as angled away from front face 14.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A stationary material mixing apparatus located within a cylindrically-shaped conduit, said conduit having upstream and downstream ends, a circular cross-section and longitudinal axis located along its geometric center, said material mixing apparatus providing for mixing an additive into a fluid stream moving from said upstream end to said downstream end within said conduit, said material mixing apparatus comprising a front face facing said upstream end and a rear face facing said downstream end and a circular periphery sized to occupy substantially the entire cross-section of said conduit, said front and rear faces of said material mixing apparatus having a geometric center, a cone-shaped module having a base and apex, said base being supported by said front face at said geometric center, said apex extending toward the upstream end of said conduit, a channel for introducing an additive to said fluid stream, said cone-shaped module being in fluid communication with said channel for passage of said additive from the apex of said cone-shaped module into said fluid stream, said stationary material mixing apparatus further comprising three circular openings configured therein for passage of said fluid stream within said conduit, said circular openings being equidistant from said geometric center spaced approximately 120 degrees from each other and each opening being fitted with a baffle, a first edge thereof being curved to mate with a circular opening to which it is fitted and a second edge, said second edge being spaced further away from said longitudinal axis than said first edge, said baffle being angled away from said front face of said mixing apparatus.

2. The stationary material mixing apparatus of claim 1 wherein each of said baffles are angled away from said front face of said mixing apparatus by approximately 20 degrees thereto.

3. The stationary material mixing apparatus of claim 1 wherein said channel for introducing an additive to said fluid stream is configured within said material mixing apparatus between said first and a second faces.

4. The stationary material mixing apparatus of claim 3 wherein said channel extends from said circular periphery to said geometric center thereof.

5. The stationary material mixing apparatus of claim 1 wherein said cylindrically-shaped conduit comprises an upstream conduit and downstream conduit, said upstream conduit having an upstream conduit flange and said downstream conduit having a downstream conduit flange, said upstream and downstream conduit flanges being configured to facilitate the joinder of said upstream and downstream conduits, said material mixing apparatus being positioned between said flanges when in use.

6. The stationary material mixing apparatus of claim 1 wherein said baffles occupy between approximately 30 to 70% of said circular openings.

* * * * *